United States Patent [19]

Everett

[11] Patent Number: 4,816,797

[45] Date of Patent: Mar. 28, 1989

[54] CONTROL DEVICE, SLIDE MEMBER THEREFOR AND METHODS OF MAKING THE SAME

[75] Inventor: Charles J. Everett, Killingworth, Conn.

[73] Assignee: Robertshaw Controls Company, Richmond, Va.

[21] Appl. No.: 194,297

[22] Filed: May 16, 1988

[51] Int. Cl.[4] ..... H01H 37/36

[52] U.S. Cl. ..... 337/314; 200/83 WM; 337/323

[58] Field of Search ..... 337/314, 313, 312, 317, 337/318, 319, 320, 321, 323, 115, 116, 117, 118, 119, 120; 200/83 WM, 83 S, 83 SA; 74/107, 567

[56] References Cited

U.S. PATENT DOCUMENTS 4,263,489 4/1981 Bergeson ..... 200/81 R
4,617,432 10/1986 Hanssen et al. ..... 200/81.R
4,696,204 9/1987 Buchshaw et al. ..... 74/56.7
4,774,489 9/1988 Kelly et al. ..... 337/314

*Primary Examiner*—H. Broome
*Attorney, Agent, or Firm*—Candor, Candor & Tassone

[57] ABSTRACT

A control device, a slide member therefor and methods of making the same are provided, the slide member being movable in a linear direction and having a cam for acting on a range spring of the control device, the frame of the control device having a substantially flat section provided with opposed sides and with a slot passing through the sides thereof, the slide member having a first part thereof acting against one of the sides of the section and a second part thereof acting against the other of the sides of the section, the slide member having a third part thereof disposed in the slot of the section and interconnecting the first part and the second part together, the first part of the slide member comprising roller bearings disposed in rolling contact with the one side of the section of the frame.

20 Claims, 3 Drawing Sheets

CONTROL DEVICE, SLIDE MEMBER THEREFOR AND METHODS OF MAKING THE SAME

BACKGROUND OF THE INVENTION

1. Field of the Invention

This invention relates to a new control device, a new slide member for the control device and to new methods of making the same.

2. Prior Art Statement

It is known to provide a control device comprising a frame means, an electrical switch means carried by the frame means, a temperature responsive unit carried by the frame means and being operatively interconnected to the switch means, the unit having a range spring means, and movable selector means carried by the frame means and being operatively interconnected to the range spring means to adjust the operating force thereof in relation to the position of the selector means, the selector means comprising a slide member movable in a linear direction and having cam means for acting on the range spring means, the frame means having a substantially flat section provided with opposed sides and with a slot means passing through the sides thereof, the slide member having a first part thereof acting against one of the sides of the section and a second part thereof acting against the other of the sides of the section, the slide member having a third part thereof disposed in the slot means of the section and interconnecting the first part and the second part together. For example, see the U.S. Pat. Nos. to Buckshaw et al, 4,696,204; to Hanssen et al, 4,617,432; to Buckshaw, 4,295,019 and to Bergeson, 4,263,489.

SUMMARY OF THE INVENTION

One feature of this invention is to provide a slide member for a control device which has unique means to overcome the frictional forces generated by the slide member as it operates a range spring means of the control device.

In particular, it was found according to the teachings of this invention that roller bearing means can be utilized by the slide member to overcome the frictional forces generated by the slide member as it operates the range spring means of the control device utilizing the slide member.

For example, one embodiment of this invention provides a control device comprising a frame means, an electrical switch means carried by the frame means, a temperature responsive unit carried by the frame means and being operatively interconnected to the switch means, the unit having a range spring means, and movable selector means carried by the frame means and being operatively interconnected to the range spring means to adjust the operating force thereof in relation to the position of the selector means, the selector means comprising a slide member movable in a linear direction and having cam means for acting on the range spring means, the frame means having a substantially flat section provided with opposed sides and with a slot means passing through the sides thereof, the slide member having a first part thereof acting against one of the sides of the section and a second part thereof acting against the other of the sides of the section, the slide member having a third part thereof disposed in the slot means of the section and interconnecting the first part and the second part together, the first part of the slide member comprising roller bearing means disposed in rolling contact with the one side of the section of the frame means.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new slide member for a control device, the slide member of this invention having one or more of the novel features of this invention as set forth above or hereinafter shown or described.

Another object of this invention is to provide a new method of making such a slide member, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
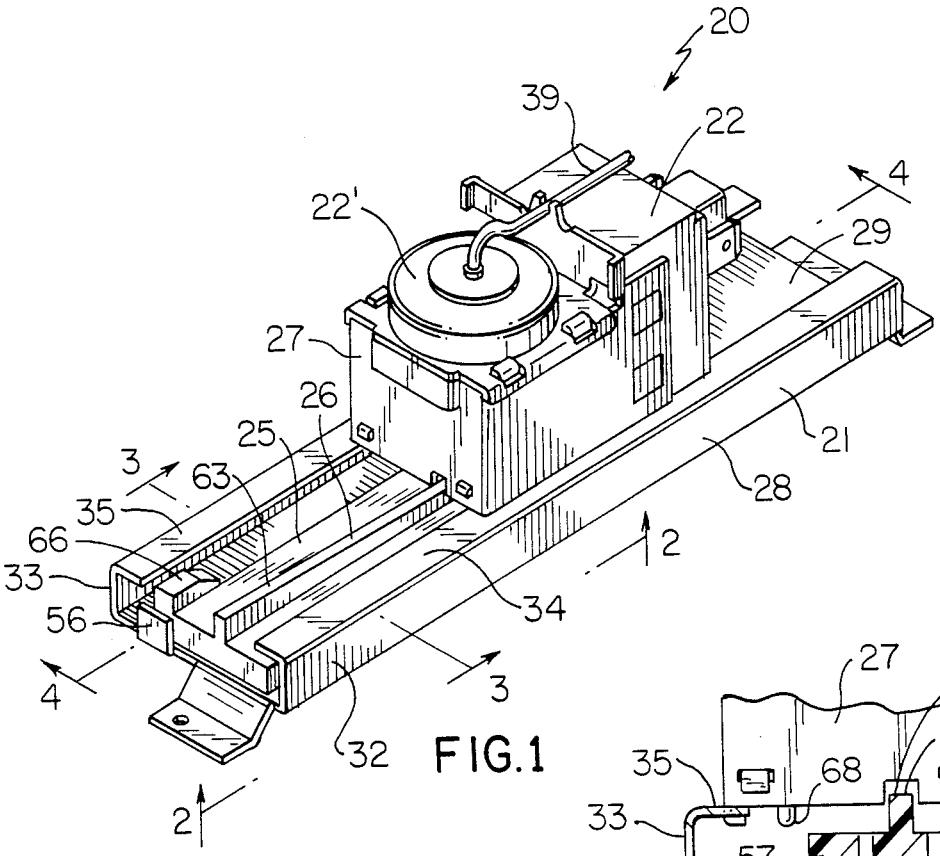
FIG. 1 is a bottom perspective view of the new control device of this invention.
Figure 3:
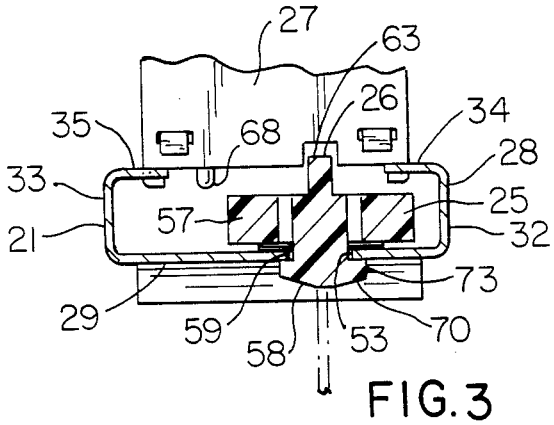
FIG. 3 is an enlarged fragmentary cross-sectional view taken on line 3—3 of FIG. 2.

While the various features of this invention are hereinafter described and illustrated as being particularly adapted to provide a control device for controlling the operation of a refrigerator or the like, it is to be understood that the various features of this invention can be utilized singly or in any combination thereof to provide a control device for other apparatus as desired.

Therefore, this invention is not to be limited to only the embodiment illustrated in the drawings, because the drawings are merely utilized to illustrate one of a wide variety of uses of this invention.

Figure 4:
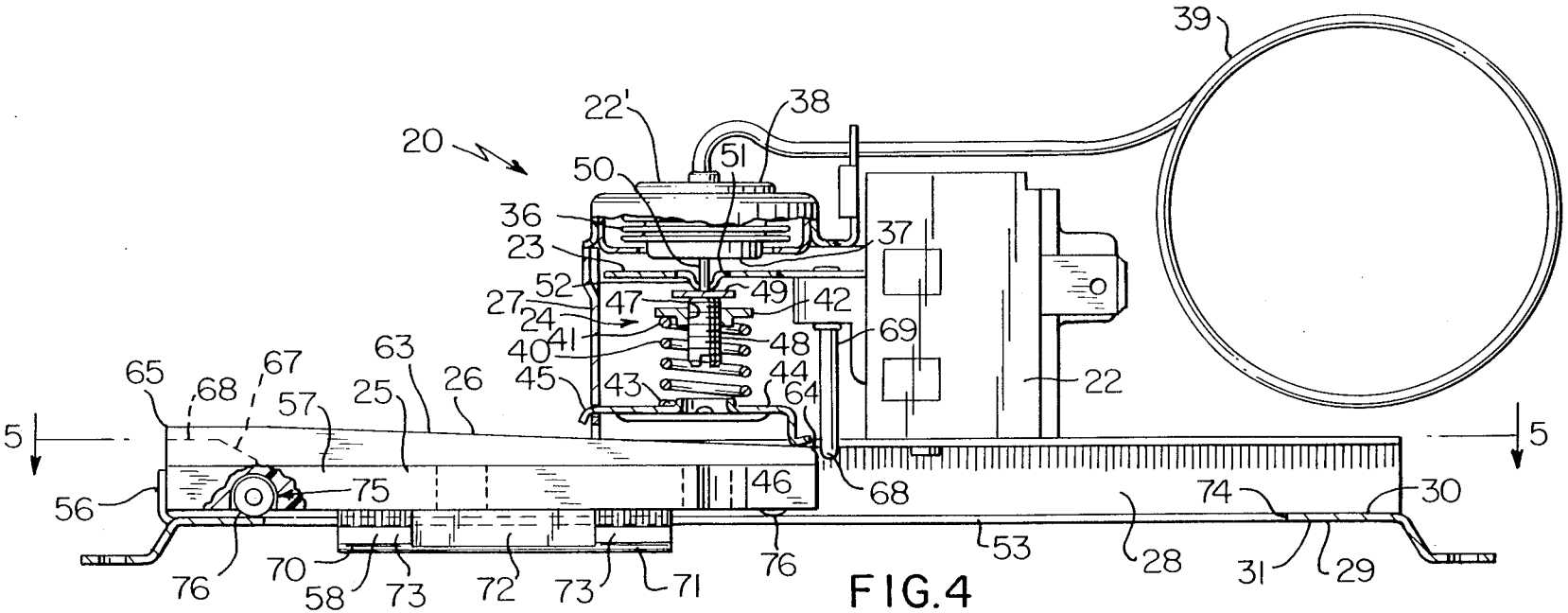
FIG. 4 is an enlarged cross-sectional view taken on line 4—4 of FIG. 1.

Referring now to FIGS. 1-5, the new control device of this invention is generally indicated by the reference numeral 20 and comprises a frame means 21, an electrical switch means 22 carried by the frame means 21, a temperature responsive unit 22' carried by the frame means 21 and being operatively interconnected to the switch means by a lever means 23, FIG. 4, in a manner hereinafter set forth, and having a range spring means that is generally indicated by the reference numeral 24, and a movable selector means 25 carried by the frame means 21 and being operatively interconnected to the range spring mean 24 in a manner hereinafter set forth to adjust the operating force of the range spring means 24 in relation to the position of the selector means 25.

The selector means 25 comprises a slide member that is movable in a linear direction and has cam means 26 for acting on the range spring means 24 in a manner hereinafter set forth.

The frame means 21 comprises a housing part 27 that contains the range spring means 24 therein and carries the temperature responsive means 22' at one end thereof as illustrated. In addition, the frame means 21 includes a part 28 secured to the part 27 in any suitable manner and being defined by a substantially flat elongated section 29 having opposed flat parallel sides 30 and 31, the flat section 29 having upstanding side flanges 32 and 33 respectively inwardly turned at their outer ends 34 and 35 thereof that are fastened to the frame part 27 in any suitable manner, such as by having tabs of the frame part 27 received through slots of the frame part 28 and folded over in a manner well known in the art.

In this manner, the housing part 28 defines a relatively long tubular portion in which the slide member 25 can slide in a linear manner as hereinafter set forth.

The temperature responsive unit 22' comprises a bellows construction 36 having a movable end wall 37 and a fixed end wall 38, the interior of the bellows construction 36 being interconnected to a capillary tube and bulb arrangement 39 in a manner well known in the art so that upon the capillary tube and bulb unit 39 sensing an increase in temperature, the fluid contained within the bellows construction 36 and capillary tube and bulb arrangement 39 expands so as to move the movable wall 37 downwardly in FIG. 4 in opposition to the force of the range spring means 24 which comprises a compression spring 40 having one end 41 bearing against a disk member 42 and another end 43 bearing against a pivotally mounted lever 44 that is pivoted at the point 45 on the housing means 21 and has a cam follower end 46 for being operated by the cam means 26 of the slide member 25 in a manner hereinafter set forth.

The disk member 42 of the range spring means 24 has an internally threaded opening 47 passing therethrough and threadedly receiving a threaded adjusting member 48 which has an end plate 49 against which a rod means 50 of the movable wall 37 of the bellows construction 36 engages, the rod means 50 passing through a suitable opening means 51 in the lever 23 which is pivotally mounted and biased in a manner to have a part 52 thereof follow the movement of the end disk 49 of the range spring means 24 so as to operate electrical switch structure within the switch means 22 in a manner well known in the art. For example, see the U.S. Pat. No. to Branson et al, 4,194,102, which illustrates in FIG. 2 thereof such a range spring means and temperature responsive unit for controlling an electrical switch means for a refrigerator control device so that further details of the structure and operation of the lever means 23 by the temperature responsive unit 22' is deemed unnecessary as the features of this invention are directed to the unique slide member 25 for operating on the cam follower end 46 of the lever 44 for adjusting the force of the range spring 40 that acts in opposition to downward movement of the movable wall 37 of the bellows construction 36 in FIG. 4 as will be apparent hereinafter.

Thus, when the left end of the lever 23 pivots upwardly in FIG. 4 because of the temperature responsive means 22' sensing a lower temperature and thereby causing the wall 37 to move upwardly by the force of the spring 40, the lever 23 operates the switch means 22 to one condition thereof and when the left end of the lever means 23 is pivoted downwardly by the temperature responsive means 22' sensing a higher temperature and thereby causing the wall 37 to move downwardly, the lever means 23 operates the switch means 22 to another operating condition thereof. However, by changing the force of the range spring 40 with the selector means 25, the temperature being required to cause the lever means 23 to change the condition of the switch means 22 is correspondingly changed as fully set forth in the aforementioned U.S. Pat. No. to Branson et al, 4,194,102, whereby this patent is being incorporated into this disclosure by this reference thereto.

Figure 2:
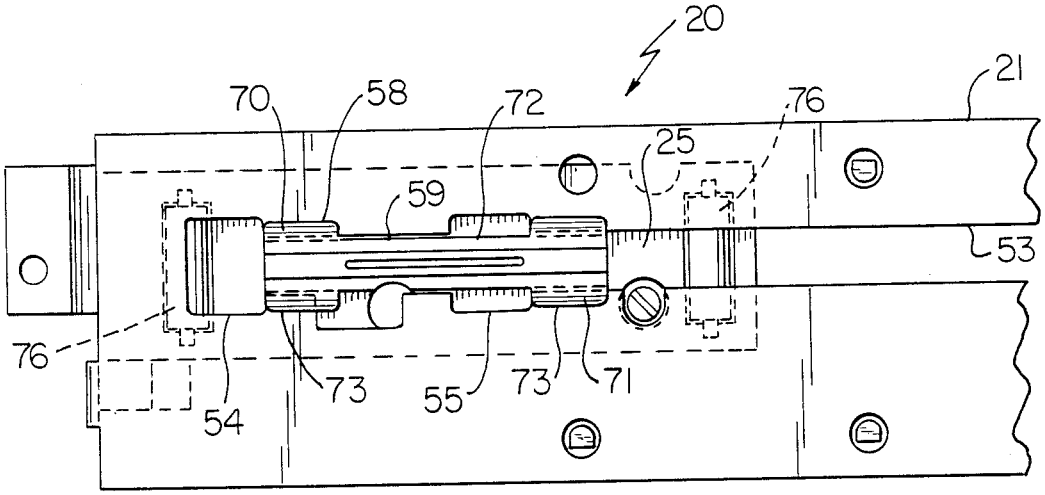
FIG. 2 is an enlarged fragmentary front view of the control device illustrated in FIG. 2 and is taken generally in the direction of the arrows 2—2 of FIG. 1.
Figure 5:
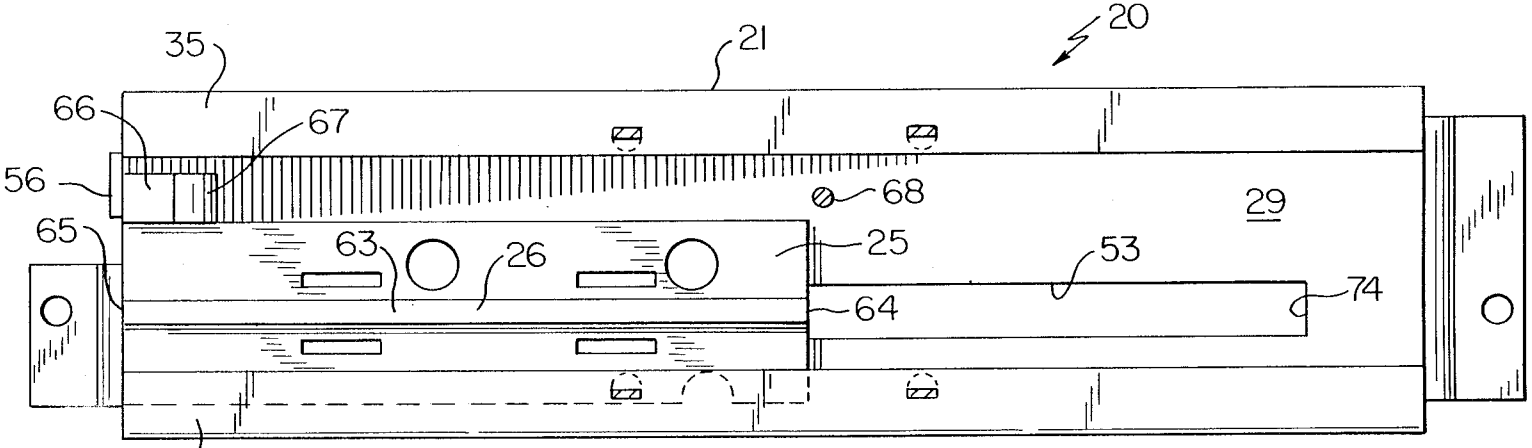
FIG. 5 is a cross-sectional view taken on line 5—5 of FIG. 4.
Figure 6:
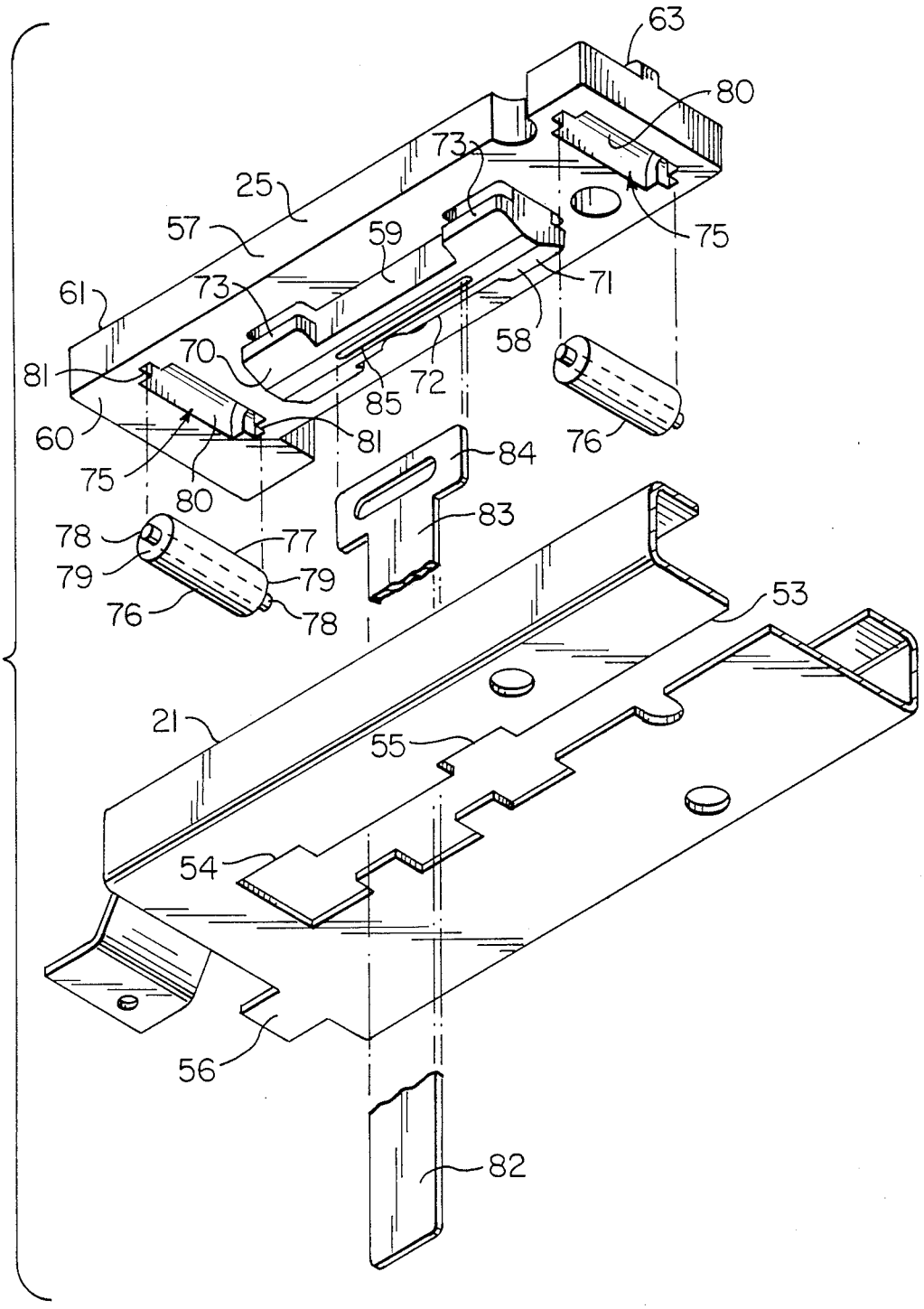
FIG. 6 is an exploded perspective view of the slide member and a frame section of the control device of FIGS. 1-5.

The straight flat section 29 of the part 28 of the frame means 21 has an elongated, substantially rectangular slot means 53 passing through the opposed sides 30 and 31 thereof with the slot means 53 having two larger rectangular sections 54 and 55 disposed in spaced apart relation, the larger section 54 being disposed at the left-hand end of the slot means 53 as illustrated in FIGS. 2 and 6 for a purpose hereinafter set forth.

While the part 28 of the frame means 21 can be formed of any suitable material, the same is formed from a flat sheet of metallic material that has been suitably stamped and formed into the configuration illustrated and is provided with an outwardly extending tang 56 at the left-hand end thereof which is adapted to be folded from the condition illustrated in FIG. 6 to the condition illustrated in FIG. 4 to hold the selector means 25 in its assembled relation therewith as will be apparent hereinafter.

The slide member 25 includes a first part 57 for being disposed adjacent the side 30 of the flat section 29 of the frame means 21, a second part 58 for being disposed adjacent the side 31 of the flat section 29 and a third part 59 for being disposed through the slot means 52 and interconnecting the first and second parts 57 and 58 together, the parts 57, 58 and 59 comprising a one-piece member being formed of any suitable material, such as polymeric material that has been molded in the configuration as illustrated.

The part 57 of the slide member 25 is substantially a flat plate portion having opposed substantially flat parallel surface means 60 and 61 with the cam means 26 comprising a raised part 62 of the surface means 61 and defining at the free edge thereof a cam surface 63 which slopes outwardly from the end 64 thereof to substantially the other end 65 thereof as fully illustrated in FIG. 4 and being adapted to act on the cam follower 46 of the lever 43 so as to pivot the lever 43 relative to the housing part 27 depending upon the portion of the cam surface 63 being engaged by the cam follower 46.

The surface means 61 of the part 57 of the slide member 25 has another raised portion 66 disposed in offset relation relative to the cam means 26 and is provided with a free cam surface 67 which is adapted to operate on an end 68 of an "off" actuator 69 of the lever 23 which when cammed by the surface 67 of the slide member 25 causes the lever means 23 to pivot to a condition to turn off the switch means 22, the structure of the "off" actuator 69 and its function being fully disclosed in the aforementioned U.S. Pat. No. to Branson et al, 4,194,102, and therefore need not be further described.

Thus, it can be seen that when the slide member 25 is moved completely to the right in FIG. 4, not only does the cam means 26 of the raised portion 62 pivot the lever 44 through the cam follower 46 thereof to its most up position and thereby increases the force of the spring 40 acting in its up direction of FIG. 4, but also the raised portion 66 acts on the "off" actuator 69 to pivot the lever 23 to turn off the switch means 22 and maintain the switch means 22 in its off condition until the slide member 25 is moved back to the left in FIG. 4 so as to clear the cam means 67 from the end 68 of the "off" actuator 69 and permit the biasing means of the lever 23 to again pivot the lever 23 to place the portion 52 into engagement with the disk 42.

The second part 58 of the slide member 25 comprises two substantially enlarged rectangular end portions 70 and 71 that are spaced apart by a narrow portion 72 of the part 58 with the narrow portion 72 being the same width as the third part 59 thereof and thereby being adapted to pass through the slot means 53 in all positions of the slide member 25 relative to the slot means 53. However, the sections 70 and 71 of the second part 58 of the slide member 25 are only adapted to pass through the enlarged rectangular portions 54 and 55 of the slot means 53 when the sections 70 and 71 are aligned therewith to permit the same to pass therethrough and then be moved to the right thereof as illustrated in FIGS. 4 and 6 so that the edge portions 73 of the sections 70 and 71 overlap onto the unslotted portion of the side 31 of the flat section 29 of the frame part 28 to prevent the same from passing back through the slot means 53.

Thus, when the selector member 25 is first assembled with the frame means 21 by having the rectangular sections 70 and 71 thereof pass through the enlarged slot openings 54 and 55, such orientation of the slide member 25 relative to the frame part 28 is only permitted when the tab 56 is in the unfolded condition illustrated in FIG. 6. After the orientation of the slide means 25 with the sections 70 and 71 having passed through the enlarged slot portions 54 and 55, the slide member 25 is moved to the right so that the edge portions 73 thereof overlap the side 31 of the section 29. The tab 56 is then bent inwardly in the manner illustrated in FIG. 4 so as to prevent the slide member 25 from moving further to the left from the condition illustrated in FIG. 4 and, thus, prevent the sections 70 and 71 from aligning with the portions 54 and 55 of the slot means 53 so that the slide member 25 is held to the flat section 29 of the frame means 21 but can slide relative thereto within the limits of the tab 56 as illustrated in FIG. 4 and the right-hand end 74 of the slot means 53.

Such method of assembling a slide member to a frame means that will carry the same and then preventing that slide member from being uncoupled therefrom is a feature that is set forth in the aforementioned U.S. Pat. No. to Buckshaw et al, 4,696,204 and the aforementioned U.S. Pat. No. to Hanssen et al, 4,617,432 whereby these two patents are being incorporated into this disclosure by this reference thereto.

The surface means 60 of the first part 57 of the slide member 25 is interrupted by a pair of like recess means 75 which respectively receive roller bearing means 76 therein, each roller bearing means 76 comprising a substantially cylindrical portion 77 and having reduced end-like shaft portions 78 extending from substantially flat ends 79 thereof. Each recess 75 has a substantially hemispherical portion 80 adapted to receive part of the cylindrical portion 77 of its respective roller bearing 76 therein and has end hemispherical portions 81 for respectively receiving the shaft-like end portions 78 of its respective bearing means 76 therein so that when the respective roller bearing means 76 is disposed in its recess means 75, a portion of the cylindrical portion 77 will extend outwardly beyond the surface means 60 for rolling engagement against the surface or side 30 of the flat section 29 of the frame means 21 in the manner fully illustrated in FIG. 3.

Thus, it can be seen that the roller bearing means 76 are unattached in the recess 75 but will roll therein on the shaft portions 78 thereof and are held within the recesses 75 by the side 30 of the frame means 21 after the selector member 25 has been assembled to the flat section 29 in the manner previously set forth.

In this manner, it is believed that the roller bearing means 76 overcome any frictional forces being imposed upon the slide member 25 and urged toward the surface means 30 of the frame section 29 by the force of the range spring 40 that is directed transverse or "normal" to that surface 30 because the roller bearing means 76 roll on the surface 30 of the frame part 28 as the slide member 25 slides relative thereto.

Accordingly, in the operation of the control device 20 of this invention, the operator can grasp a handle portion 82 of a member 83 that has an enlarged end 84 fastened within a slot 85 of the selector member 25 in any suitable manner and slide the selector member 25 in the slot means 53 to various positions so as to have different portions of the cam surface 63 adjacent the cam follower 46 of the lever 44 so that the range spring 40 will have its force properly set for tending to maintain the proper temperature with the control device 20 as previously set forth, the sliding movement of the selector member 25 being enhanced by the rolling of the roller bearings 76 against the side 30 of the frame structure 29.

Thus, it can be seen that the control device 20 of this invention provides a variable temperature switch means in which the actuating point thereof may be adjusted by merely sliding the temperature selector member 25 in a linear manner rather than with a rotating dial as set forth in the aforementioned U.S. Pat. No. to Branson et al, 4,194,102. The device 20 of this invention also provides a dedicated "off" position as the selector member 25 has both the temperature varying cam means 26 and the dedicated "off" cam means 67 thereon which makes unnecessary a number of parts and assembly operations and thereby reduces cost so as to make the device 20 economically advantageous over other designs designed to operate in this manner which most often require electronics. The roller bearing means 76 of this invention are provided to overcome the frictional forces generated by the sliding selector member 25 as it operates the range spring 40 which has its force transverse or "normal" to its direction of travel of the slide member 25. The device 20 of this invention also allows for the necessary temperature discrimination over its end use limited "travel throw" without the application of "rack and pinion" gears or other means which would greatly increase its size, complexity and cost.

Therefore, it can be seen that this invention not only provides a new control device and a new slide member therefor, but also this invention provides new methods of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a frame means, an electrical switch means carried by said frame means, a temperature responsive unit carried by said frame means and being operatively interconnected to said switch means, said unit having range spring means, and movable selector means carried by said frame means and being operatively interconnected to said range spring means to adjust the operating force thereof in relation to the position of said selector means, said selector means comprising a slide member movable in a linear direction and having cam means for acting on said range spring means, said frame means having a substantially flat section provided with opposed sides and with a slot means passing through said sides thereof, said slide member having a first part thereof acting against one of said sides of said section and a second part thereof acting against the other of said sides of said section, said slide member having a third part thereof disposed in said slot means of said section and interconnecting said first part and said second part together, the improvement wherein said first part of said slide member comprises roller bearing means disposed in rolling contact with said one side of said section of said frame means.

2. A control device as set forth in claim 1 wherein said roller bearing means comprises a plurality of roller bearings disposed in spaced apart relation.

3. A control device as set forth in claim 2 wherein each roller bearing has an axis of rotation that is disposed substantially transverse to the direction of sliding movement of said slide member.

4. A control device as set forth in claim 3 wherein said first part of said slide member comprises a surface means that faces said one side of said section of said frame means, said surface means having a plurality of recess means formed therein, said roller bearings respectively having portions thereof disposed in said recess means.

5. A control device as set forth in claim 4 wherein said slot means substantially bisects said roller bearings.

6. A control device as set forth in claim 4 wherein said one side of said section of said frame means holds said roller bearings in said recess means of said slide member.

7. A control device as set forth in claim 1 wherein said first part of said slide member comprises a surface means that faces away from said one side of said section of said frame means, said cam means comprising a longitudinally disposed raised portion of said surface means.

8. A control device as set forth in claim 7 wherein said switch means has an "off" actuator thereof, said surface means of said slide member having another raised portion thereof for engaging said actuator when said slide member is moved to its "off" position.

9. A control device as set forth in claim 8 wherein the other raised portion of said surface means of said slide member is offset relative to said cam means.

10. A slide member for a control device having an electrical switch means carried by a frame means and having a temperature responsive unit carried by said frame means and being operatively interconnected to said switch means, said unit having a range spring means, said slide member comprising a movable selector means to be carried by said frame means and be operatively interconnected to said range spring means to adjust the operating force thereof in relation to the position of said selector means, said slide member to be movable in a linear direction and having cam means for acting on said range spring means, said slide member having a first part thereof for acting against one of the opposed sides of a flat section of said frame means and a second part thereof for acting against the other of said sides of said section, said slide member having a third part thereof for being disposed in a slot means of said section and interconnecting said first part and said second part together, the improvement wherein said first part of said slide member comprises roller bearing means adapted to be disposed in rolling contact with said one side of said section of said frame means.

11. A slide member as set forth in claim 10 wherein said roller bearing means comprises a plurality of roller bearings disposed in spaced apart relation.

12. A slide member as set forth in claim 11 wherein each roller bearing has an axis of rotation that is disposed substantially transverse to the direction of sliding movement of said slide member.

13. A slide member as set forth in claim 12 wherein said first part of said slide member comprises a surface means that is adapted to face said one side of said section of said frame means, said surface means having a plurality of recess means formed therein, said roller bearings respectively having portions thereof disposed in said recess means.

14. A slide member as set forth in claim 13 wherein said roller bearings comprise two roller bearings disposed on opposite sides of said third portion thereof.

15. A slide member as set forth in claim 4 wherein said roller bearings are unattached in said recess means of said slide member.

16. A slide member as set forth in claim 10 wherein said first part of said slide member comprises a surface means that is adapted to face a:;ay from said one side of said section of said frame means, said cam means comprising a longitudinally disposed raised portion of said surface means.

17. A slide member as set forth in claim 16 wherein said surface means of said slide member has another raised portion thereof for engaging an "off" actuator of said switch means when said slide member is moved to its "off" position.

18. A slide member as set forth in claim 17 wherein the other raised portion of said surface means of said slide member is offset relative to said cam means.

19. In a method of making a control device comprising a frame means, an electrical switch means carried by said frame means, a temperature responsive unit carried by said frame means and being operatively interconnected to said switch means, said unit having a range spring means, and movable selector means carried by said frame means and being operatively interconnected to said range spring means to adjust the operating force thereof in relation to the position of said selector means, said selector means comprising a slide member movable in a linear direction and having cam means for acting on said range spring means, said frame means having a substantially flat section provided with opposed sides and with a slot means passing through said sides thereof, said slide member having a first part thereof acting against one of said sides of said section and a second part thereof acting against the other of said sides of said section, said slide member having a third part thereof disposed in said slot means of said section and interconnecting said first part and said second part together, the improvement comprising the step of forming said first part of said slide member to comprise roller bearing means disposed in rolling contact with said one side of said section of said frame means.

20. In a method of making a slide member for a control device having an electrical switch means carried by a frame means and having a temperature responsive unit carried by said frame means and being operatively interconnected to said switch means, said unit having a range spring means, said slide member comprising a movable selector means to be carried by said frame means and be operatively interconnected to said range spring means to adjust the operating force thereof in relation to the position of said selector means, said slide member to be movable in a linear direction and having cam means for acting on said range spring means, said slide member having a first part thereof for acting against one of the opposed sides of a flat section of said frame means and a second part thereof for acting against the other of said sides of said section, said slide member having a third part thereof for being disposed in a slot means of said section and interconnecting said first part and said second part together, the improvement comprising the step of forming said first part of said slide member to comprise roller bearing means adapted to be disposed in rolling contact with said one side of said section of said frame means.

* * * * *